United States Patent [19]

Barlow

[11] Patent Number: 4,628,874

[45] Date of Patent: Dec. 16, 1986

[54] ROLLER FOLLOWER AXLE RETENTION

[75] Inventor: Bruce S. Barlow, Saginaw, Mich.

[73] Assignee: Eaton Corporation, Cleveland, Ohio

[21] Appl. No.: 792,936

[22] Filed: Oct. 30, 1985

[51] Int. Cl.[4] ..... F01L 1/16; B21K 1/20

[52] U.S. Cl. ..... 123/90.5; 123/90.51; 123/90.44; 123/90.27; 123/90.39; 29/156.7 B

[58] Field of Search ..... 123/90.5, 90.51, 90.44, 123/90.27, 90.39; 29/156.7 B

[56] References Cited

U.S. PATENT DOCUMENTS

| | | | |
|---|---|---|---|
| 2,322,173 | 6/1943 | Spencer | 123/90.44 |
| 2,322,174 | 6/1943 | Spencer | 123/90.44 |
| 2,935,878 | 5/1960 | Wirsching | 123/90.5 |
| 3,139,076 | 6/1964 | Flaherty | 123/90.5 |
| 3,668,945 | 6/1972 | Hofmann | 123/90.5 |
| 4,089,234 | 5/1978 | Henson et al. | 123/90.5 |
| 4,361,120 | 11/1982 | Kueny | 123/90.5 |

*Primary Examiner*—Ira S. Lazarus

*Attorney, Agent, or Firm*—C. H. Grace; R. A. Johnston

[57] ABSTRACT

A hydraulic tappet has a roller receiving recess in one end thereof defining spaced parallel axle supporting wall portions. Cross holes are formed in the supporting wall portions with an annular groove formed in the inner periphery of each cross hole. An end of an axle with a roller thereon is received in each cross hole. The ends of the axle are deformed to bulge radially outwardly to contact the inner periphery of the cross holes. The grooves prevent stress fracturing and increase axle push-out loads.

11 Claims, 8 Drawing Figures

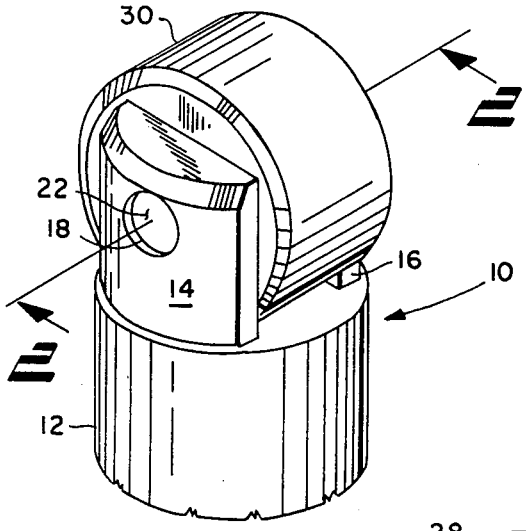
Fig. 1
Fig. 2
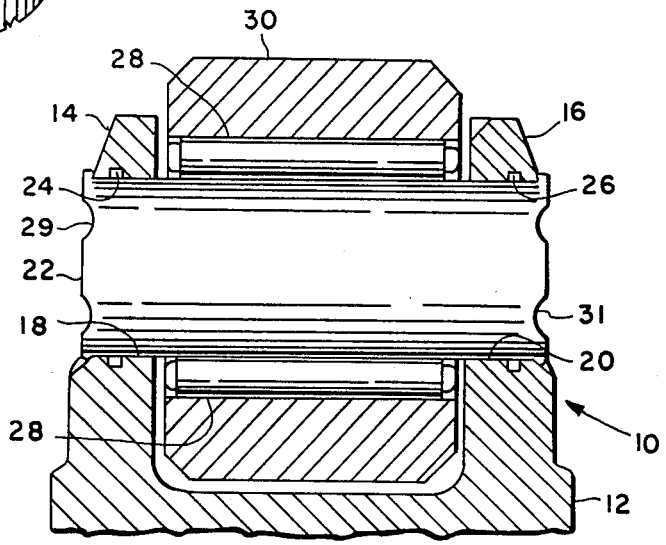
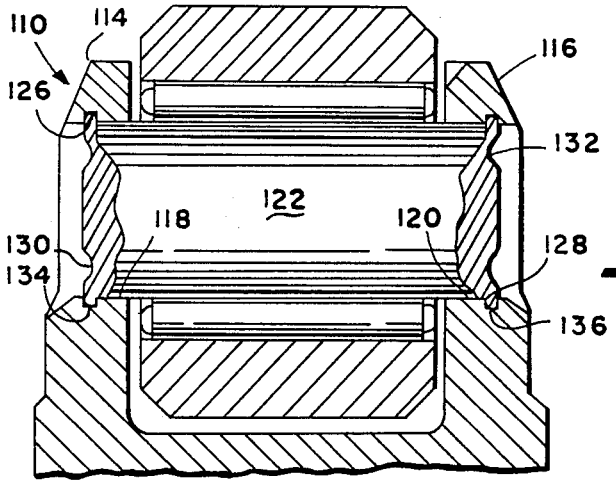
Fig. 3

ROLLER FOLLOWER AXLE RETENTION

BACKGROUND OF THE INVENTION

The present invention relates to cam followers or tappets for the valve gear of an internal combustion engine, and particularly relates to cam followers of the type having a roller or wheel provided on the end thereof for rolling contact with the surface of a rotating lobe on the engine cam shaft. Tappets of the aforementioned type are known in the internal combustion engine as roller followers and are employed to reduce friction between the cam shaft and the cam follower for the purpose of increasing the power output of the engine, i.e. reducing friction losses and to improve the wear life of the cam shaft and cam follower.

It has been found desirable in some instances to retrofit existing production internal combustion engines, and particularly engines for mass produced automotive applications, with roller follower tappets where the engine was originally designed and manufactured with tappets having the ends thereof in direct frictional sliding engagement with the lobe of the cam shaft. Where it is desired to retrofit an existing production automotive engine with roller follower tappets, it is desired to do so without otherwise altering the engine block to minimize changes in the remaining valve gear components. In order to accomplish such a retrofit of roller follower tappets, it is necessary to incorporate the roller on the end of a tappet substantially within the dimensional envelope of the existing engine tappet to eliminate the necessity of relocating the camshaft and minimize alterations to other valve gear components. In order to achieve such an incorporation of a roller on the end of an existing tappet substantially within the original tappet envelope, it has been found economical to provide a slot or recess in the end of the tappet in a manner so as to form a pair of spaced parallel support portions extending from the end of the tappet, and to provide cross holes for receiving therein the axle of the roller with the roller nestled between the parallel support portions. The roller has a diameter sufficiently great so that the peripheral surface thereof extends beyond the end of the tappet. Thus, the roller will contact the cam lobe and roll thereon preventing contact of the end of the tappet portions with the cam.

Where an existing production engine tappet incorporates therein internal hydraulic lash adjusting means, the material and the construction of the tappet body are dictated by the requirements of the tappet envelope, clearance and wear requirements. In particular, in certain engine valve gear, there is a requirement for a close sliding fit between the tappet and the engine guide bore to prevent loss of engine oil which is pressure-fed from an engine oil port in the tappet guide bore to a collector ring on the surface of the tappet for flow through a port to the interior of the tappet. It has been found that compatible iron alloy materials are satisfactory and in particular, medium and low carbon steels are suitable materials for the tappet body in order to provide a wear surface that will maintain the proper clearance between the tappet and the guide bore in the engine and also provide the required wear life in engine service.

Thus, where roller followers are to be retrofitted into the valve gear of an existing production engine, it has been found difficult to provide a recess in the end of the tappet for receiving the roller therein and yet provide sufficient material for support of and retention of the roller axle in the body portions which form the sides of the roller receiving recess and to provide such axle support and yet permit the use of relatively low cost materials. For example, prior attempts to incorporate a roller in the end of a hydraulic tappet compatible for use in an existing iron block production engine have resulted in fracture of the tappet body material in the region about the apertures formed in the support portions for receiving the transversely disposed roller axle.

In particular, problems have been experienced in retaining the axle for a roller follower in the end of a hydraulic tappet where the ends of the axle are deformed, by techniques such as orbital staking, for retaining the axle securely in the end of the tappet. Previously, it has been found necessary to ream and hone the transversely formed aperture in the support portions of the tappet for providing a precision fit with the roller axle in order that, upon deformation of the axle material, sufficient retaining forces are developed in the aperture by the deformation of the axle material. This reaming and honing of the transverse axle receiving holes in the tappet has proven to be prohibitively costly for mass production of roller follower hydraulic tappets for automotive engines. Furthermore, even where reaming and honing have been employed to ensure a precision fit of the axle before orbital staking, it has been found that after staking sufficient stresses have been developed in the tappet body arm portions that fracturing has occurred.

SUMMARY OF THE INVENTION

The present invention provides a unique way or means of manufacturing a roller follower hydraulic tappet for an engine in which the end of the tappet has a recess formed therein to thereby provide a pair of spaced axle supporting portions, each having a traverse aperture formed therein for receiving respectively one end of a roller axle therein. The aperture formed in each of the support portions has regions thereof, intermediate the ends of the aperture, provided with an annular recess formed therein. The ends of the axle when received in the apertures, are locally deformed by suitable means, such as orbital staking, and the material of the axle ends is deformed to contact the wall of the aperture and the recesses to thereby provide stress relieving about the deformed portion of the axle. The localized deformation provides positive engagement between the axle and the aperture for preventing pushout of the roller axle.

The unique roller axle retention technique of the present invention eliminates not only stress cracking, but also the need for reaming and honing the transverse holes in the tappet prior to assembling the roller follower axle therein; and, it produces a roller axle retention that is more resistant to push-out and permits the use of more cost-effective materials.

BRIEF DESCRIPTION OF THE DRAWINGS

FIG. 1 is a somewhat perspective view of the roller end of a roller follower tappet in accordance with the present invention;

FIG. 2 is a portion of a section view taken along section indicating lines 2—2 of FIG. 1;

FIG. 3 is a view similar to FIG. 2 of another embodiment of the invention;

DETAILED DESCRIPTION

Figure 4:
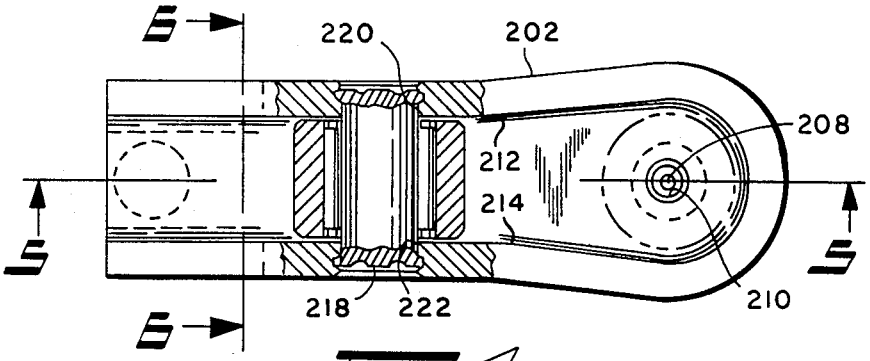
FIGS. 4 and 4*a* are top views of the rocker arm embodiment of the invention.

Referring now to FIG. 1, the roller follower tappet of the present invention is indicated generally at 10 as having a body 12 which houses the hydraulic lash adjusting plunger mechanism (not shown) and has, at one end thereof, a plurality of support portions in the form of arms 14, 16 extending therefrom longitudinally in generally spaced parallel relationship. Each of the axle supporting portions 14, 16 has a transverse aperture, one of which is indicated at 18 in FIG. 1 formed therein, with the apertures in the portions 18, 16 axially coincident. The apertures, such as 18, each have one end of an axle 22 received therein and the axle has provided thereon a roller wheel 30.

Referring now to FIG. 2, the arm portions 14, 16 are shown in greater detail and as each having an annular circumferential groove respectively 24, 26 formed in the inner periphery of each of the apertures 18, 20. The axle 22 is received with its ends disposed in the apertures 18, 20. Axle 22 has a plurality of needle bearings 28 disposed thereabout intermediate the arms 14, 16 and a roller follower 30 is received over the axle 22 and disposed between the arms 14, 16 and journalled on the needle bearings 28 for rotation about the axle.

In the presently preferred practice of the invention, the axle pin 22 is made of bearing steel and has the central region thereof contacted by the needle bearings 28 hardened to a minimum of 60 on the Rockwell "C" scale. The ends of the axle 22 are subjected to axial compression by a suitable tool and are deformed such that the material of the axle pin is expanded radially outwardly in the region adjacent the grooves 24, 26 and some of the material of the axle pin expands to engage the corners of the grooves 24, 26 at the radially inner diameter thereof. However, it has been found that the bulk of the radial expansion of the axle pin in the end region occurs against the inner wall of the apertures 18, 20 and frictionally engages the surface of these latter surfaces.

Figure 7:
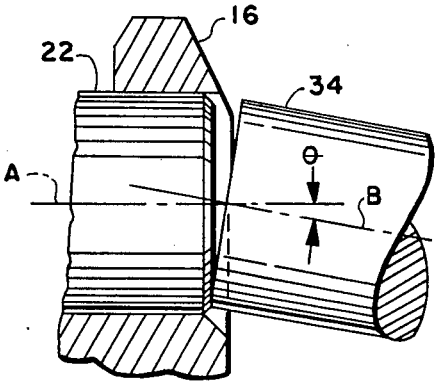

Referring now to FIG. 7, the arrangement of the tool for axially compressing the end regions of the axle 22 is shown wherein in a rod having a right circular cylindrical configuration has the axis denoted "B" in FIG. 7 thereof inclined at an angle denoted by the Greek letter Theta ($\theta$) to the axis denoted "A" in FIG. 7 of the actual pin 22. The rod 34 is maintained pressed against the end of the axle 22 with sufficient force to cause deformation thereof; and, the rod 34 is orbited about the axis A, while the angle ($\theta$) is maintained. This orbiting of the rod 34 produces localized deformation of the rim of the axle pin and is known as orbital staking. The ends of the axle are indented by the orbital staking tool 34 and the resultant indent is shown in the form of annular recesses 29, 31 in FIG. 2.

In the presently preferred practice of the invention, the body 12 may be made of low carbon steel or nodular cast iron or low carbon steel for the embodiment of FIG. 3 and medium carbon steel for the embodiment of FIG. 2. The regions comprising the axle supporting portions 14, 16 are hardened to a minimum of 42 on the Rockwell "15N" scale. The grooves 24, 26 are generally small in dimension with reference to the diameter pin 22; and, in particular, the grooves 24, 26 have a width in the direction of the pin axis of less than 20% of the width of the portions 14, 16. It will thus be understood that the grooves 24, 26 are not of sufficient width to permit appreciable radial bulging of the material of the axle 22 into the grooves. The grooves 24, 26 thus serve to relieve residual stresses created in the arms 14, 16 by the radial bulging of the pin 22 into contact with the inner periphery of the apertures 18, 20.

The grooves 24, 26 in the embodiment of FIG. 2 are axially located in the apertures 18, 20 so as to be spaced adjacent the ends of the axle 22. In the embodiment of FIG. 2, the axle pin 22 has the length thereof sized so as to extend the entire width of the tappet body 12 and to provide sufficient material to be deformed over the outer surface of the portions 14, 16.

Referring to FIG. 3, another embodiment of the invention is indicated generally at 110, wherein a tappet body has a pair of spaced parallel axle supporting portions, indicated at 114, 116 provided thereon and each having a transverse aperture, respectively 118, 120 formed therethrough with one end of an axle pin 122 received in the aperture 120 and the other end received in aperture 118.

A suitable annular recess 126 is formed in the periphery of the aperture 118. Similarly, an annular recess 128 is formed in the periphery of aperture 120. The recesses 126, 128 are disposed intermediate the ends of the respective apertures 118, 120. It will be understood that in the embodiment of FIG. 3, the axle 122 has the ends thereof truncated to extend axially within the apertures, such as 120, only an amount sufficient to cover the annular recess 126. Thus, the embodiment of FIG. 3 requires a shorter axle pin to be employed than in the embodiment of FIG. 2. It will be understood that the ends of the axle pin 122 are orbitally staked in the manner as shown in FIG. 7. The orbital staking leaves annular indents 130, 132 in the ends of axle 122, as shown in FIG. 3. It will be understood that the material of the axle ends, when deformed by orbital staking, expands radially outwardly into grooves 126, 128 thereby forming slight end flanges 134, 136 on the ends of the axle pin 122. The end flanges 134, 136 serve to retain the axle pin in the support portions 114, 116 and resist push-out loads on the axle pin.

Figure 4A:
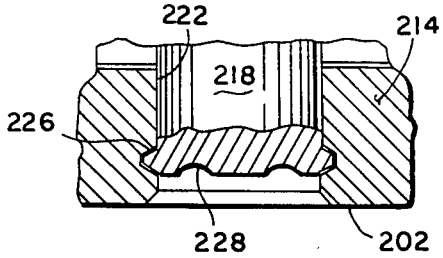
Figure 5:
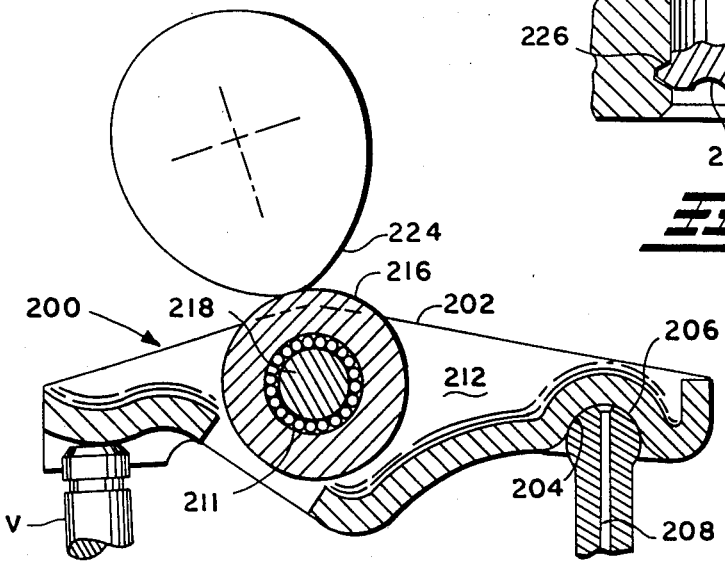
FIG. 5 is an enlarged view of a portion of FIG. 4.
Figure 6:
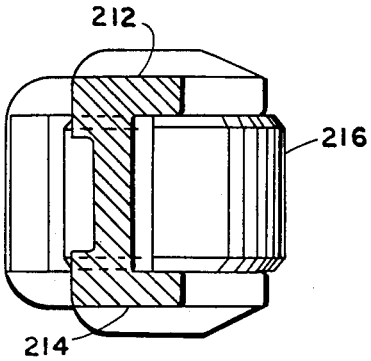
FIG. 6 is a section view taken along section-indicating lines 6—6 of FIG. 4; and, FIG. 7 is a view showing the orbital staking tool in place for staking.

Referring now to FIGS. 4, 4*a* and 5, the invention is illustrated as embodied in an end-pivot rocker arm for engine valve gear having a cam-over-rocker or high-cam type valve gear. With reference to FIG. 5, the embodiment indicated generally at 200 employs a rocker arm 202 having a generally spherical recess 204 provided in one end thereof, which recess is pivotally received on a stationary ball-pivot member 206. The pivot member 206 has a passage 208 provided therein, which is adapted to receive a supply of lubricant from the engine oil galleries for lubricating the pivot 206. The rocker arm 202 has a generally U-shaped configuration in traverse section as shown in FIG. 6, with legs or sides thereof denoted by numerals 212, 214 in FIG. 6, which extend in spaced parallel arrangement.

Referring to FIG. 5, a roller follower wheel is disposed between the parallel sides 212, 214 of the rocker arm and is journalled by a plurality of needle bearings 211, received over an axle pin 218. The roller follower 216 is sized so that the periphery thereof extends above the edge surface of the sides 212, 214 of the rocker arm.

The opposite ends of the axle pin 218 are each respectively received in a cross-bores namely, cross-bore 220 provided in the side 212 and cross-bore 222 provided in the side 214 of the rocker arm 202.

The roller follower 216 is adapted to have the periphery thereof contacted in a force transmitting manner by an engine cam such as the cam 224 shown in FIG. 5. It will be understood that rotation of the cam 224 against the roller follower 216 causes the rocker arm to reciprocate about the pivot surface 206 with the opposite end of the rocker arm operatively contacting the end of combustion chamber poppet valve denoted by the reference character "V" in FIG. 5.

Referring now to FIGS. 4 and 4*a*, the end of the axle pin 218 is shown typically as received in cross-bore 222 in the side 214 of the rocker arm 202. The bore 222 has an annular recess denoted by reference numeral 226 in FIG. 4*a* formed therein adjacent the outer surface thereof. The axle pin has its length sized in the FIG. 5 embodiment such that the end of the axle 218 extends across the width of the groove 226. It will be understood that a similar groove is disposed in the bore 220 for side 212 of the rocker arm, which for the sake of simplicity of illustration will not be described in detail, but which groove is visible in FIG. 4.

Referring again to FIG. 4*a*, the end of the axle pin 218 is deformed by a suitable means, such as for example orbital staking by the technique described herein with respect to FIG. 7, on the end face thereof. The orbital staking creates an annular indent or recess denoted at 228 in the end face as a result of the staking. The material about the periphery of the axle pin at its end is thus deformed radially outwardly by the orbital staking operation and extends into the groove 226 to provide retention of the axle pin in the rocker. It will be understood that the orbital staking of the axle pin 218 is accomplished in the same manner as that illustrated in FIG. 7.

The present invention thus provides a unique roller cam follower structure in which the roller axle-receiving holes have stress relieving annular grooves provided therein which prevent fracture cracking of the tappet body or rocker arm upon orbitally staking the axle pin into the body and produce higher axle push-out loads.

Although the invention has been described hereinabove with respect to the illustrated embodiments, it will be understood that modifications and variations may be made in the invention which is limited only by the following claims.

I claim:

1. A roller follower tappet for the valve gear of an internal combustion engine comprising:

(a) body means having an end defining a pair of axle supporting portions disposed in generally spaced parallel relationship, with each of said portions having an axle receiving aperture formed transversely therethrough;

(b) an annular recess formed about the inner periphery of each of said apertures intermediate the axial ends thereof;

(c) an axle having a roller thereon, said axle received through said apertures with said roller disposed to extend between said supporting portions with each end of said axle received in one of said portions;

(d) said axle having the material of the periphery of each end thereof deformed for contacting the wall of said aperture for positively retaining said axle in said body means.

2. The roller follower defined in claim one, wherein said annular recess has a generally rectangular configuration in transverse section.

3. The roller follower defined in claim one, wherein said portions are formed of material selected from the group consisting of through-hardened iron base alloy, low carbon steel or medium carbon steel.

4. The roller follower defined in claim one, wherein said axle has a length not greater than the distance between said apertures.

5. The roller follower defined in claim one, wherein said axle has a length greater than the distance between said grooves; and, said portions are formed of through-hardened medium carbon steel.

6. The roller follower defined in claim one, wherein axle material is deformed by orbital staking on the ends thereof.

7. A method of making a roller cam follower tappet comprising the steps of:

(a) forming a tappet body and providing certain portions thereof extending in spaced parallel arrangement and forming an aperture transversely in each of said portions;

(b) forming an annular recess in the periphery of each of said apertures;

(c) providing an axle with a roller thereon and disposing each end of said axle in one of said apertures;

(d) deforming the ends of said axle into contact with the inner periphery of said apertures.

8. The method defined in claim 7, wherein said step of deforming comprises the step of orbitally staking the ends of said axle.

9. The method defined in claim 7, wherein the step of deforming comprises inclining a rod to the axis of said axle and respectively pressing the inclined end of said rod against each end of said axle and orbiting said rod about an axis coincident with the axis of said axle.

10. The method defined in claim 7 further comprising the step of hardening the region of said axle intermediate said ends to a hardness of 60 on the Rockwell "C" scale.

11. The method defined in claim 7, wherein the step of deforming comprises orbitally staking the ends of said axle and deforming the material thereof radially outwardly and into contact with the edges of said recesses.

* * * * *